United States Patent [19]

Gottwald et al.

[11] Patent Number: 4,490,185

[45] Date of Patent: Dec. 25, 1984

[54] PHOSPHATING SOLUTIONS AND PROCESS

[75] Inventors: Karl-Heinz Gottwald, Erftstadt; Reinhard Opitz, Duren, both of Fed. Rep. of Germany

[73] Assignee: Henkel Kommanditgesellschaft auf Aktien, Duesseldorf, Fed. Rep. of Germany

[21] Appl. No.: 556,746

[22] Filed: Nov. 30, 1983

[30] Foreign Application Priority Data

Dec. 3, 1982 [DE] Fed. Rep. of Germany ..... 3244715

[51] Int. Cl.[3] ..... C23F 7/10

[52] U.S. Cl. ..... 148/6.15 Z

[58] Field of Search ..... 148/6.15 Z

[56] References Cited

U.S. PATENT DOCUMENTS

| | | | |
|---|---|---|---|
| 3,104,177 | 9/1963 | Corwin | 148/6.15 Z |
| 3,338,755 | 8/1967 | Jenkins | 148/6.15 Z |
| 3,819,385 | 6/1974 | Schumichen | 148/6.15 Z |
| 4,265,677 | 5/1981 | Müller et al. | 148/6.15 |
| 4,292,096 | 9/1981 | Murakami et al. | 148/6.15 |

FOREIGN PATENT DOCUMENTS

| | | | |
|---|---|---|---|
| 665499 | 6/1963 | Canada | 148/6.15 Z |
| 738950 | 7/1966 | Canada | 148/6.15 Z |
| 2818426 | 11/1978 | Fed. Rep. of Germany | 148/6.15 Z |
| 2080835 | 2/1982 | United Kingdom | 148/6.15 Z |
| 2093075 | 8/1982 | United Kingdom | |

*Primary Examiner*—Sam Silverberg

*Attorney, Agent, or Firm*—Ernest G. Szoke; Henry E. Millson, Jr.; Mark A. Greenfield

[57] ABSTRACT

A process for phosphating metal surfaces, particularly iron, steel and zinc-plated steel, by treating them with aqueous, acidic zinc phosphate baths at only moderately elevated temperatures in the range of from 22° to 38° C. The baths used have 2 to 6 g/l of Zn; 4 to 23 g/l of $PO_4^{3-}$; a free acid content of 0.05 to 0.4 points; and a pH-value of 3.0 to 4.0. The ratio of Zn to $PO_4^{3-}$ is preferably in the range from 1:2 to 1:11. The baths can advantageously contain nickel-(II)-ions, with a nickel content not exceeding a Zn:Ni ratio of 1:0.5. This process gives iron-containing zinc phosphate layers having an iron content of from 5 to 20% by weight and is particularly useful for pretreatment for subsequent cathodic electro-dip-lacquering.

20 Claims, No Drawings

PHOSPHATING SOLUTIONS AND PROCESS

This invention relates to a process for phosphating metals, particularly iron, steel and zinc-plated steel, with aqueous acidic baths containing zinc phosphate and, if desired, standard activating additives and/or additives which improve layer formation. The new process is particularly suitable for the pretreatment of metal surfaces for subsequent cathodic electro-dip-lacquering.

BACKGROUND OF THE INVENTION

There are today several characteristic types of bath and associated process conditions for phosphating metal surfaces. Conventional zinc phosphate baths work at comparatively high temperatures in the range of from 50° to 60° C. and form substantially iron-free zinc phosphate layers on the metal surface. Subsequent developments have made it possible to incorporate iron in the zinc phosphate layers deposited and, hence, to produce particularly satisfactory, stable zinc phosphate layers using baths comparatively poor in zinc and rich in phosphate, again at comparatively high temperatures. Thus, U.S. Pat. No. 4,265,677 describes aqueous, acidic phosphating solutions having a ratio by weight of Zn to $PO_4$ of 1:(12–110) for the surface treatment of metals. The thin and uniform phosphate coatings are particularly suitable as a base for subsequent electro-dip-lacquering. Known accelerators for phosphating baths of the type in question are, for example, nitrite ions and/or aromatic nitro compounds, cf. U.S. Pat. No. 4,292,096.

By contrast, British patent No. 2,093,075 A seeks to obtain better results by working at temperatures in the range of from 30 ° to 60° C. with chlorate-containing zinc phosphate solutions containing from 0.5 to 1.5 g/l of Zn, from 0.4 to 1.3 g/l of Ni, from 10 to 26 g/l of $P_2O_5$ and from 0.8 to 5 g/l of $ClO_3$, to which no nitrite is added and in which the ratio by weight of Zn to Ni is adjusted to a value of 1:(0.5–1.5), the ratio by weight of Zn to $P_2O_5$ to a value of 1:(8–85) and the ratio of free $P_2O_5$ to total $P_2O_5$ to a value of 0.005 (at approximately 30° C.)–0.06 (at approximately 60° C.):1. The quality of the phosphate layers obtained by this process is said to be critically determined by maintenance of the concentration ratio between Zn and $P_2O_5$. For a $P_2O_5 \rightarrow PO_4$ conversion factor of 1.338, the lower limit of that ratio ($Zn/P_2O_5 = 1/8$) is at 10.7 parts by weight of $PO_4$ to 1 part by weight of Zn.

All these proposals of the prior art use comparatively high total acid contents or, in other words, are characterized by a high consumption of chemicals per unit volume of the aqueous treatment solution. Any reduction in this consumption of chemicals would improve the economy of phosphating processes of the type in question to a very considerable extent. For example, the loss of material attributable to carryover would be distinctly reduced, which would in turn reduce the overall consumption of chemicals.

DESCRIPTION OF THE INVENTION

Starting from existing knowledge of the phosphating of metal surfaces, the object of the present invention is to provide acidic, aqueous zinc-phosphate-containing baths which operate with a distinctly lower total acid content. At the same time, however, the invention seeks to ensure the production of high-quality zinc phosphate layers which have comparatively high iron contents and which, therefore, are particularly suitable for subsequent cathodic electro-dip-lacquering. At the same time, the invention seeks to provide a process which can be effectively carried out at very low temperatures.

Achievement of the above-stated objects of the invention is based on the discovery that, by combining certain bath parameters, it is possible effectively to reduce the total acid content and hence to obtain the desired reduction in the consumption of chemicals, while at the same time the desired iron-containing zinc phosphate layers can be effectively deposited at temperatures below 40° C. using these baths.

In a first embodiment, therefore, the present invention relates to a process for phosphating metal surfaces, particularly iron, steel, and zinc-plated steel, or combinations of such surfaces such as are increasingly used in car bodies, by treating them with aqueous, acidic zinc phosphate baths at only moderately elevated temperatures.

The new process is carried out by contacting the metal surface to be phosphated at a temperature in the range of from about 22 to about 38° C. using a phosphating bath which complies with the following conditions: from about 2 to about 6 g/l of zinc; from about 4 to about 23 g/l of $PO_4^{3-}$; a total free acid content of from about 0.05 to about 0.4 points and a pH-value of the bath of from about 3.0 to about 4.0.

Determination of the free acid content on a points basis and also the points of total acid, which will be discussed hereinafter, is carried out by known methods (cf. for example "Die Phosphatierung von Metallen", Leuze-Verlag/Saulgau, 1974, pages 274–277:

The number of points of free acid corresponds to the consumption in ml of 0.1N NaOH in the titration of 10 ml of bath solution until the first $H_3PO_4$-stage changes color (indicator methyl orange or bromphenol blue).

The number of points of total acid corresponds to the consumption in ml of 0.1 N NaOH in the titration of 10 ml of bath solution against phenolphthalein as the indicator.

Accordingly, the process of the invention uses comparatively high contents of zinc in the bath solution, particularly compared with the prior-art literature cited above, while at the same time using only relatively small quantities of phosphate ions, and therefore only limited quantities of total acid.

It is preferred to use baths in which the ratio of Zn to $PO_4^{3-}$ is in the range of from about 1:2 to about 1:11, and preferably from about 1:2 to about 1:10.5. Baths in which the ratios of Zn to $PO_4^{3-}$ are in the range of from about 1:2 to about 1:8 and, more particularly, in the range from about 1:2 to about 1:4 are especially preferred.

Insofar as the $PO_4^{3-}$ content of the bath is concerned, this means that comparatively low concentrations of $PO_4^{3-}$ are used. Thus, the $PO_4^{3-}$- content of the bath is preferably in the range of from about 4 to about 15 g/l of bath solution and, more preferably, from about 4 to about 13 g/l of bath solution. It is particularly preferred to use a $PO_4^{3-}$-content in the range of from about 4 to about 8 g/l of bath solution.

Concerning the weight/volume range given above for zinc, it is preferred to select a value from the lower end of that range. In one particularly preferred embodiment of the invention, the zinc content of the phosphating bath amounts to between about 2 and about 4 g per liter of bath solution. The preferred free acid content amounts to between about 0.1 and about 0.2 points. The preferred pH-range for the phosphating baths of the invention is from about 3.5 to about 4.0. Baths of this type can be effectively operated at the temperature range given above of from about 22° to about 38° C.

It is essential both to the process of the invention and to the results obtained therewith that the particular combination of parameters selected in accordance with the invention should enable zinc phosphate layers having a high iron content to be formed. In the preferred embodiment of the invention, the zinc phosphate layers formed have iron contents in the range of from about 5 to about 20% by weight. Accordingly, the process of the invention provides phosphating layers which, presumably by virtue of their high content of phosphophyllite, show the high stability required for subsequent cathodic electro-dip-lacquering.

According to the invention, it is preferred to use phosphating baths in which the total acid content does not exceed values of the order of 30 points. Phosphating baths having a total acid content of from about 8 to about 30 points, and preferably in the range of from about 9 to about 15 points, are particularly suitable for use in the present process.

The phosphating solutions of the invention can additionally contain auxiliary components and constituents normally used in solutions of this type. However, one factor of particular importance in this respect is that, contrary to standard practice, there is no longer any need to use manganese. This constitutes an important advantage of the process of the invention over other characteristic prior-art baths and, above all, over the so-called low-zinc baths which operate at comparatively high temperatures.

Standard activating additives (accelerators) include such components as chlorate, nitrate, nitrite, hydrogen peroxide, aromatic nitro compounds, simple and/or complex fluorides and/or organic and/or inorganic complexing agents. With respect to such bath additives, the following observations are appropriate:

The addition of chlorate is generally recommended. The chlorate content is preferably in the range of from about 0.1 to about 30 g per liter of bath solution, and more preferably in the range of from about 1.5 to about 10 g per liter of bath solution. Any nitrate ions used are preferably present in concentrations of from about 1 to about 10 g per liter of bath solution. If it is intended to use nitrite ions in the bath, a concentration thereof in the range of from about 0.01 to about 1 g per liter of bath solution is particularly suitable. Hydrogen peroxide can be used in the same concentration range. Aromatic nitro compounds, particularly 3-nitrobenzene sulfonic acid or its salts, and also other members of this class of compounds, for example nitro-resorcinol or nitrobenzoic acid, are known acceleators for use in phosphating baths. Compounds of this type are preferably used in quantities of from about 0.01 to about 2 g per liter of bath solution.

Layer formation on the metal surfaces can be improved in a known manner by the addition of simple and/or complex fluorides. The content of fluoride ions is preferably in the range of from about 0.01 to about 2 g per liter of bath solution. In addition to or instead of the simple fluoride ion, the $SiF_6^{2-}$-ion, for example, can be used as the complex fluoride, in which case concentration ranges thereof of from about 0.01 to about 2 g per liter of bath solution are also preferred.

The solutions can also contain known organic or inorganic complexing agents. Such organic complexing agents are, for example, tartaric acid or tartrate, hydroxy ethylene diamino-triacetic acid or its salts, gluconic acid or its salts, and/or citric acid or its salts. Inorganic complexing agents include polyphosphates, for example tripolyphosphate or hexametaphosphate. Complexing agents of this type are normally present in the bath in quantities of from about 0.01 to about 5 g per liter.

In addition to zinc, the treatment bath can contain other metal cations, particularly divalent metal cations. It is of advantage for the phosphating bath to contain nickel-(II) ions. In the preferred embodiments of the invention, however, the nickel content is limited in comparison with the zinc content and is at most equivalent to the zinc content. However, the Zn/Ni ratio preferably does not exceed a value of approximately 1:0.5. According to the invention, preferred nickel contents are in the range from about 0.01 to about 1 g per liter of bath solution.

The present invention further provides a concentrated aqueous composition for formulating the acid aqueous phosphate solutions of the present invention. The present acidic aqueous phosphate solutions are conveniently prepared by diluting an aqueous concentrate which contains a number of the solution ingredients in proper weight ratios, and then adding other ingredients as needed to prepare the treating solutions of the invention. The concentrates are advantageously formulated to contain zinc ion and phosphate ion in a weight proportion of 2 to 6:4 to 23. The concentrates preferably contain a weight proportion of zinc ion and phosphate ion of 2 to 4:4 to 15. The concentrates are preferably formulated to contain at least about 25 g/l, more preferably from about 50 g/l to about 130 g/l of zinc ion.

Other ingredients such as nickel ion can also be present in the concentrated compositions and are present in the same weight proportions as in the phosphating solutions of the invention. However, care must be taken in forming the concentrates. For example, it is not advisable to add any phosphating accelerator to the concentrate, since the accelerators tend to decompose and cause other problems.

The process of the present invention for phosphating clean metal surfaces by use of the phosphating solutions of the invention can be carried out by spray treatment, dip treatment, or by a combination of such treatments. Spray treatment can usually be effected by spraying at a temperature of from about 22° C. to about 38° C. for from about 30 seconds to about 5 minutes, and preferably from about 30 seconds to about 3 minutes, in order to form an adequate phosphate film which exhibits the desired performance characteristics.

Dip treatment is an embodiment which is more preferable than spray treatment in the process of the present invention. In order to form an adequate phosphate film which exhibits the desired performance characteristics, the dip treatment is usually effected at a temperature of from about 22° C. to about 38° C. for at least about 1 minute, preferably for about 2 minutes to about 15 minutes. Alternatively, the treatment can be effected by first spray treating for from about 5 seconds to about 3 minutes, and then dip treating for at least about 15 seconds, preferably from about 1 minute to about 15 minutes.

It can be useful, although by no means necessary, to subject the metal surfaces to be treated to a known activating pretreatment before they are treated in the phosphating baths of the invention. Activating agents based on titanium phosphate, for example are suitable for this pretreatment.

Although high-iron zinc phosphate layers formed in accordance with the invention are suitable for any of the applications for which hitherto known phosphate layers are normally used, they are particularly advantageous for subsequent cathodic electro-dip-lacquering. For this use, they are characterized by high resistance of the lacquer film to lacquer migration under corrosive stress and by firm, satisfactory adhesion of the lacquer to the metal substrate. Accordingly, the process of the invention can be used in commercial practice, for example, in the phosphating of car bodies.

The invention will be illustratd by the following examples which are not intended to limit the invention.

EXAMPLE 1

A concentrate was prepared from 58 g of ZnO, 1 g of $NiCO_3$, 125 g of $H_3PO_4$, 46 g of $HNO_3$, 1 g of tartaric acid, 50 g of $NaClO_3$ and water to 1000 g. This concentrate was then diluted to form a solution containing 0.18% of Zn, 0.002% of Ni, 0.46% of $PO_4$, 0.17% of $NO_3$, 0.004% of tartrate and 0.15% of $ClO_3$. The total acid content amounted to 9.8 points. The free acid was reduced by the addition of sodium hydroxide to a pH-value in the range of from about 3.5 to about 4.

Steel workpieces were cleaned by spraying them for 2 minutes at 40° C. with an alkaline cleaning solution and then rinsing them with water. The workpieces were then phosphated by spraying for 2 minutes at 35° C. with the working solution described above.

The workpieces were then rinsed with water, rerinsed with distilled water, and dried by blowing with compressed air. The workpieces were then coated with a cathodic electro-dip-lacquer and dried by heating for 20 minutes at 185° C. The dry film was 18 um thick. The workpieces were then provided with single cuts and subjected to the salt spray test according to DIN 50021 for a total of 240 hours. Evaluation in accordance with DIN 53167 revealed a downward migration of <0.1 mm. It follows from this result that, despite the low treatment temperature, this procedure provides a good coating.

EXAMPLE 2

A concentrate was prepared from 100 g of ZnO, 288 g of $H_3PO_4$, 32 g of $HNO_3$, 40 g of $NaClO_3$, 4 g of gluconic acid, and water to 1000 g. This concentrate was diluted to form a solution containing 0.48% of Zn, 1.68% of $PO_4$, 0.19% of $NO_3$, 0.19% of $ClO_3$ and 0.024% of gluconate. The solution had a total acid content of 25.5 points. The free acid was reduced by the addition of sodium hydroxide to a pH-value in the range of from about 3.5 to about 4. 0.1 g/l of $NaNO_2$ was then added to the solution.

Steel workpieces were cleaned by immersion for 5 minutes at 50° C. in an alkaline cleaning solution and then rinsed with water. The workpieces were then phosphated by immersion for 5 minutes at 32° C. in the working solution described above. The workpieces were then rinsed with water, rerinsed with distilled water and then dried by blowing with compressed air. The workpieces were then coated with a cathodic electro-dip-lacquer and dried by heating for 20 minutes at 185° C.

The dry film was 18 μm thick. The workpieces were then provided with single cuts and subjected to the salt spray test according to DIN 50021 for a total of 240 hours. Evaluation in accordance with DIN 53167 revealed a downward migration of <0.1 mm. It follows from this result that, despite the low treatment temperature, the proposed procedure provides a good coating.

EXAMPLE 3

A concentrate was prepared from 60 g of ZnO, 125 g of $H_3PO_4$, 50 g of $HNO_3$, 50 g of $NaClO_3$, 1 g of $H_2SiF_6$, 1 g of HF, 2 g of 3-nitrobenzene sulfonic acid and water to 1000 g. This concentrate was diluted to form a solution containing 0.34% of Zn, 0.85% of $PO_4$, 0.34% of $NO_3$, 0.27% of $ClO_3$, 0.007% of $SiF_6$, 0.007% of F and 0.014% of 3-nitrobenzene sulfonic acid. The solution had a total acid content of 14.4 points. The free acid was reduced by the addition of sodium hydroxide to a pH-value in the range from 3.5 to 4.

Steel workpieces were cleaned by spraying for 2 minutes at 40° C. with an alkaline cleaning solution and then rinsed with water. The workpieces were then phosphated by spraying for 1 minute with the above-described working solution followed by immersion therein for 2 minutes at a temperature of 32° C. The workpieces were then rinsed with water, rerinsed with distilled water, and dried by blowing with compressed air. The workpieces were then coated with a cathodic electro-dip-lacquer and dried by heating for 20 minutes at 185° C.

The dried film was 18 μm thick. The workpieces were then provided with single cuts and subjected to the salt spray test according to DIN 50021 for a total of 240 hours. Evaluation in accordance with DIN 53167 revealed a downward migration of <0.1 mm. It follows from this result that, despite the low treatment temperature, the proposed procedure provides a good coating.

What is claimed is:

1. A process for phosphating a metal surface comprising contacting said metal surface at a temperature of from about 22° to about 38° C. with an aqueous solution consisting of:

(a) from about 2 to about 6 g/l of Zn;
(b) from about 4 to about 23 g/l of $PO_4^{-3}$;
(c) a free acid content of from about 0.05 to about 0.4 points;
(d) a pH value of from about 3.0 to about 4.0; and, optionally, an effective amount of at least one of the following:
(e) chlorate ion;
(f) nitrate ion;
(g) nitrite ion;
(h) hydrogen peroxide;
(i) an aromatic nitro compound;
(j) a simple or $SiF_6^{-2}$ fluoride ion;
(k) a complexing agent;
(l) nickel ion;

and wherein the ratio of Zn to $PO_4^{-3}$ is in the range of from about 1:2 to about 1:11.

2. A process in accordance with claim 1 wherein said metal surface is ferrous, zinc-plated ferrous, or a combination of such surfaces.

3. A process in accordance with claim 1 wherein in (b) the $PO_4^{-3}$ content is from about 4 to about 15 g/l.

4. A process in accordance with claim 3 wherein the $PO_4^{-3}$ content is from about 4 to about 8 g/l.

5. A process in accordance with claim 1 wherein said ratio is from about 1:2 to about 1:4.

6. A process in accordance with claim 1 wherein in (a) from about 2 to about 4 g/l of Zn is present, in (c) from about 0.1 to about 0.2 points of free acid are present, and in (d) the pH range is from about 3.5 to about 4.0.

7. A process in accordance with claim 1 wherein the temperature is from about 28° to about 38° C.

8. A process in accordance with claim 1 wherein the solution contains from about 0.01 to about 1 g/l of nickel ions and wherein the Zn to Ni ratio does not exceed about 1:0.5.

9. A process in accordance with claim 1 wherein the composition of the solution is controlled to give a zinc phosphate coating containing from about 5 to about 20% by weight of iron.

10. A process in accordance with claim 1 wherein a quantity of solution is used such that the solution has a total acid content of from about 8 to about 30 points.

11. A process in accordance with claim 10 wherein the total acid content is from about 9 to 15 points.

12. A process in accordance with claim 1 wherein said contacting is carried out by spraying, by dipping, or by a combination fo spraying and dipping.

13. A process in accordance with claim 1 wherein the phosphated metal surface is subsequently cathodicly electro-dip lacquered.

14. An aqueous phosphating solution for phosphating metal surfaces consisting of:

(a) from about 2 to about 6 g/l of Zn;
(b) from about 4 to about 23 g/l of $PO_4^{-3}$;
(c) a free acid content of from about 0.05 to about 0.4 points;
(d) a pH value of from about 3.0 to about 4.0; and, optionally, an effective amount of at least one of the following:
(e) chlorate ion;
(f) nitrate ion;
(g) nitrite ion;
(h) hydrogen peroxide;
(i) an armatic nitro compound;
(j) a simple or $SiF_6^{-2}$ fluoride ion;
(k) a complexing agent;
(l) nickel ion;

and wherein the ratio of Zn to $PO_4^{-3}$ is in the range of from about 1:2 to about 1:11.

15. An aqueous phosphating solution in accordance with claim 14 wherein in (b) the $PO_4^{-3}$ content is from about 4 to about 15 g/l.

16. An aqueous phosphating solution in accordance with claim 15 wherein the $PO_4^{-3}$ content is from about 4 to about 8 g/l.

17. An aqueous phosphating solution in accordance with claim 14 wherein said ratio is from about 1:2 to about 1:4.

18. An aqueous phosphating solution in accordance with claim 14 wherein in (a) from about 2 to about 4 g/l of Zn is present, in (c) from about 0.1 to about 0.2 points of free acid are present, and in (d) the pH range is from about 3.5 to about 4.0.

19. An aqueous phosphating solution in accordance with claim 14 wherein the solution contains from about 0.01 to about 1 g/l of nickel ions and wherein the Zn to Ni ratio does not exceed about 1:0.5.

20. An aqueous concentrated composition consisting of zinc ion and phosphate ion in a weight proportion of 2 to 6:4 to 23, and wherein at least about 25 g/l of zinc ion is present in the concentrate, wherein the weight ratio of zinc ion to phosphate ion is from about 1:2 to about 1:11; and wherein nickel ion can optionally be present in a zinc to nickel ratio of not more than about 1:0.5.

* * * * *